US009316067B1

(12) United States Patent
Lu et al.

(10) Patent No.: US 9,316,067 B1
(45) Date of Patent: Apr. 19, 2016

(54) COILED TUBING INJECTOR HANDLER

(71) Applicant: National Oilwell Varco, L.P., Houston, TX (US)

(72) Inventors: Mike Xiaolei Lu, Arlington, TX (US); David W. McCulloch, Arlington, TX (US)

(73) Assignee: National Oilwell Varco, LP, Houston, TX (US)

( * ) Notice: Subject to any disclaimer, the term of this patent is extended or adjusted under 35 U.S.C. 154(b) by 0 days.

(21) Appl. No.: 14/698,815

(22) Filed: Apr. 28, 2015

(51) Int. Cl.

| | |
|---|---|
| ***E21B 19/22*** | (2006.01) |
| ***E21B 19/08*** | (2006.01) |
| ***E21B 15/00*** | (2006.01) |
| *E21B 17/20* | (2006.01) |

(52) U.S. Cl.
CPC ..... *E21B 19/08* (2013.01); *E21B 15/00* (2013.01); *E21B 19/22* (2013.01); *E21B 17/20* (2013.01)

(58) Field of Classification Search
CPC ..... E21B 19/22; E21B 7/02; E21B 7/023
See application file for complete search history.

(56) References Cited

U.S. PATENT DOCUMENTS

| | | | | | |
|---|---|---|---|---|---|
| 3,109,523 | A * | 11/1963 | Moller | ..... | 52/115 |
| 3,705,634 | A * | 12/1972 | Casagrande | ..... | 175/122 |
| 5,839,514 | A * | 11/1998 | Gipson | ..... | 166/384 |
| 6,129,226 | A * | 10/2000 | Donovan | ..... | 212/300 |
| 7,040,411 | B2 | 5/2006 | Kainer et al. | | |
| 7,077,209 | B2 | 7/2006 | McCulloch et al. | | |
| 8,690,514 | B2 * | 4/2014 | Marola | ..... | 414/563 |
| 2004/0206551 | A1 * | 10/2004 | Carriere et al. | ..... | 175/203 |
| 2005/0247456 | A1 | 11/2005 | Wise et al. | | |
| 2007/0125551 | A1 | 6/2007 | Havinga | | |
| 2007/0295497 | A1 * | 12/2007 | Pleskie et al. | ..... | 166/77.2 |
| 2009/0218106 | A1 * | 9/2009 | Stukey et al. | ..... | 166/384 |

OTHER PUBLICATIONS

"Enhanced QuikRig Coiled Tubing System," Halliburton, Boots & Coots, Jan. 2014, 6 pages.

"BOP Handling and Transporter System," Veristic Manufacturing, Inc., printed on Sep. 22, 2014, 1 page.

* cited by examiner

*Primary Examiner* — Blake Michener
*Assistant Examiner* — Kipp Wallace
(74) *Attorney, Agent, or Firm* — Derek V. Forinash; Porter Hedges LLP

(57) ABSTRACT

A coiled tubing handler lifts and extends outwardly over wellhead a support platform on which a coiled tubing injector is mounted. The handler collapses into a compact arrangement that allows it and the coiled tubing injector to be transported to a well site on a vehicle or trailer, and then used at the well site to raise, position and support the coiled tubing injector connected to a blow out preventer and riser assembly for connection to a well head. The support platform may be tilted backward and forward, shifted from side-to-side, and raised and lowered on the platform.

13 Claims, 5 Drawing Sheets

COILED TUBING INJECTOR HANDLER

TECHNICAL FIELD OF THE INVENTION

The invention pertains generally to handling of coiled tubing injectors at well sites.

BACKGROUND

Coiled tubing is commonly used in a wide range of oilfield services and operations. It can be run into and out of a well bore at a high rate, relative to straight, jointed pipe, and, unlike wire line, it can be pushed into the well bore. It can be used to particular advantage in highly deviated wellbores found in extended reach drilling. Coiled tubing refers to a continuous string of steel pipe that is continuously milled and coiled onto a large take-up reel for transportation and handling. It can be used, for example, for drilling, but it is more often used after the well is drilled for logging, cleanouts, fracturing, cementing, fishing, completion and production related operations.

Coiled tubing is run in and out of well bores using machines called coiled tubing injectors. The name "coiled tubing injector" derives from the fact that, in preexisting well bores, the tubing may need to be forced or "injected" into the well through a sliding seal to overcome the pressure of fluid within the well, until the weight of the tubing in the well exceeds the force produced by the pressure acting against the cross-sectional area of the pipe. However, once the weight of the tubing overcomes the pressure, the injector must hold the tubing.

There are a number of different types and configurations of coiled tubing injectors capable of handling coiled tubing used in oilfield operations. Most coiled tubing injectors have a head comprised of two continuous chains, each mounted on sets of spaced-apart sprockets, so that there is an extended length of chain between the sprockets. One or more motors drive or turn the chains. Typically the motors are hydraulic, though other types of motors can be used. Each motor is connected to one or more of the sprockets. The chains are arranged so that the coiled tubing entering the injector is held between the chains by grippers mounted to each of the chains. The grippers are pressed against the outer diameter of the tubing thereby generating a frictional force parallel to the axis of the tubing. The frictional force is directly related to the normal force applied by the grippers.

The coiled tubing injector, a reel of coiled tubing, a control cabin, and equipment for operating the injector are typically transported to a well site as a single unit—a "coiled tubing unit" (CTU). Typically, the coiled tubing unit is transported to a well site to perform well intervention work of various types, usually as components mounted on a truck, trailer or several trailers, depending on the unit configuration. The riser is made one or more sections of straight pipe that extends from the blow out preventers attached to the wellhead. The riser accommodates elongated, rigid tools that are attached to the end of the coiled tubing prior to being lowered into the well bore. The connections between these components must comprise bolted flanges at pressures above 10,000 pounds per square inch (PSI) (approximately 89 MPa). At lower pressures connections between the components can be made with quick unions. The coiled tubing injector is connected to the riser with a stripper, through which the coiled tubing is pushed or pulled. Because there is no derrick or platform, a mobile crane is typically driven to the site to assist with holding the coiled tubing injector high enough so that it can be attached to the top of the BOP assembly. The crane is also used to carry the weight of the coiled tubing injector and BOP assembly, as well as to counter the bending moment on the wellhead caused by the tension placed on the coiled tubing by the reel. However, a temporary structure could also be erected above the wellhead for these purposes. A mast as disclosed in U.S. Pat. No. 7,077,209 could also be used.

SUMMARY

The invention relates to one or more aspects of a transportable handler for positioning a coiled tubing injector on top of a BOP assembly for connection with a wellhead of an oil or natural gas well, and supporting it while coupled with the wellhead, such as during interventional or work over operations.

DETAILED DESCRIPTION OF EXEMPLARY EMBODIMENTS

Figure 1:
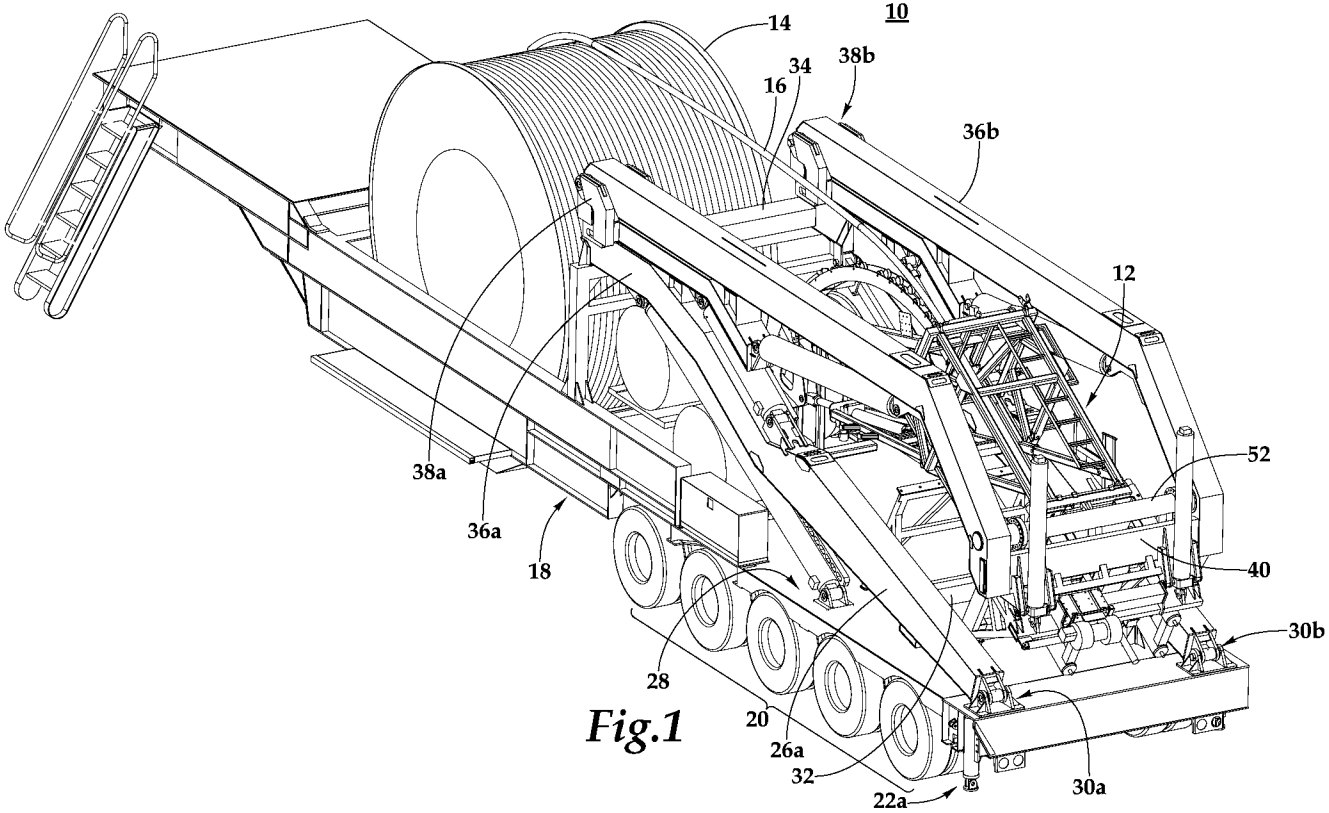
FIG. 1 is a perspective view of a coiled tubing unit with a coiled tubing handler in a transport or stowed position.

In the following description, like numbers refer to like elements.

A representative embodiment of a handler for a coiled tubing injector implementing or embodying various aspects of the invention is comprised of a linkage and a platform supporting a coiled tubing injector. This representative embodiment supports and manipulates a coiled tubing injector with the tubing always "stabbed," that is, with the tubing from a tubing reel extending over a tubing guide and into the top of the coiled tubing injector, ready to run. The linkage is comprised of at least two rigid links pivotally connected to raise the support platform and coiled tubing injector from a stowed position over a wellhead. Each rigid link of the linkage is, in the representative embodiment illustrated in the drawings, comprised of a set of spaced apart, parallel arms, between which the support platform and the coiled tubing injector are located. The support platform is coupled to the linkage in a manner that permits it and the coiled tubing injector to be tilted or be rotated about a horizontal axis, parallel to the direction in which the linkage moves the support platform. The rotation of a platform allows the injector connected with it to be tilted for transport, thereby lowering its profile so that its total height above a roadway permits it to be transported over in the region where the handler will be transported. The coupling of the platform to the linkage also permits the support platform to be rotated during extension of the linkage so that it remains oriented generally vertically after it is moved from the transport position, toward a position on which it will be attached to a BOP assembly on the wellhead.

In the representative embodiment the coiled tubing injector is mounted on a support that is translatable side-to-side or laterally on the platform, in a direction generally perpendicular to the direction in which the linkage lifts and extends the support platform. The side-to-side movement assists with placing the injector and the pressure control stack connected to it more precisely onto the wellhead. The rigid links forming the linkage may be manipulated in such a way that the coiled tubing injector and pressure control equipment can be raised and lowered, as well as moved toward or away from the rear of the base, such as trailer, to which the handler is mounted, to a point directly over the wellhead. Once the rigid links have been adjusted to support the injector directly over the wellhead, the injector support on the platform may be moved up and down with respect to the platform, allowing for vertical movement, relative to the platform, of the coiled tubing injector without changing the position of the support arms. The injector support on the platform allows for precise control to assist with setting the coiled tubing injector and pressure control stack onto a studded connection typically found on a wellhead. Extendable members, taking the form of hydraulic cylinders in the illustrated embodiment, are used to move or pivot the links of the linkage. An optional transition arm between the two rigid links allow for two, shorter hydraulic cylinders to be used in place of a single long one. Shorter extendable members are less likely to buckle than longer members, thus allowing the handler to carry larger loads.

FIGS. 1-5 illustrate one example of a transportable coiled tubing unit comprising a handler 10, coiled tubing injector 12, a reel 14 of coiled tubing 16. The example is intended to be representative of coiled tubing units generally, and the illustrated handler is representative example of the embodiment of the handler described above. The unit is mounted, in this example, on a trailer 18 with wheels 20, for transport to a well site. Note that coiled tubing injector assembly 12 shown in the figures is actually just a frame in which a coiled tubing injector head, not shown, is mounted. The frame is intended to be representative of coiled tubing injector assemblies generally. Representative examples of coiled tubing injectors can be found in U.S. Pat. Nos. 6,059,029 and 8,544,536, each of which is incorporated herein for all purposes by reference. The coiled tubing injector assembly 12 includes a gooseneck or arched tubing support 13 for transitioning the coiled tubing from the reel into the top of the injector while it is being used. The arch tubing support 13 prevents the coil tubing from bending too much or kinking, thus allowing the reel 14 to place tension on the tubing 16 without damaging the tubing. The coiled tubing unit could also be mounted on a bed of a truck, on a skid, or on some other type of motor vehicle for transport to the well site. The unit includes all equipment necessary to operate the handler and the coiled injector, including a hydraulic power pack (not shown), hydraulic control circuits (not shown), and operator controls for allowing an operator to manipulate the handler and run the coiled tubing injector. Operator cabin 21, shown only in FIGS. 2 and 4, may be provided for a person operating the handler and coiled tubing injector. Input controls and status displays would be located in the operator cabin.

A tractor, not shown, would be used to pull the trailer to a well site, close to the wellhead. A representative example of a wellhead 23 is shown in FIG. 4. The handler 10 is shown in a stowed or transport position in FIGS. 1 and 2. It is shown in extended positions in FIGS. 3 and 4. In the transport position, coil tubing injector 12 lays at an angle. The arched tubing guide 13 prevents the injector from lying completely flat. The overall height of the injector, when measured from the ground is, in this particular example, approximately the same height as the handler 10 when it is in a stowed position. This allows it to be transported over public roadways and low enough to pass under bridges.

In this example, trailer 18 includes a set of outriggers 22*a* and 22*b* for stabilizing the trailer when maneuvering the coiled tubing injector. The outriggers are shown deployed in FIG. 3. Outriggers can also be used to tilt the trailer from side-to-side. The trailer serves as the base for the handler. Tilting the trailer about its central axis with the outriggers allows the handler 10 to be tilted in order to align it with wellhead that might not be perfectly vertical. Although not shown in FIG. 1 or 3, the trailer 12 will conventionally include an operator cabin 21.

Figure 3:
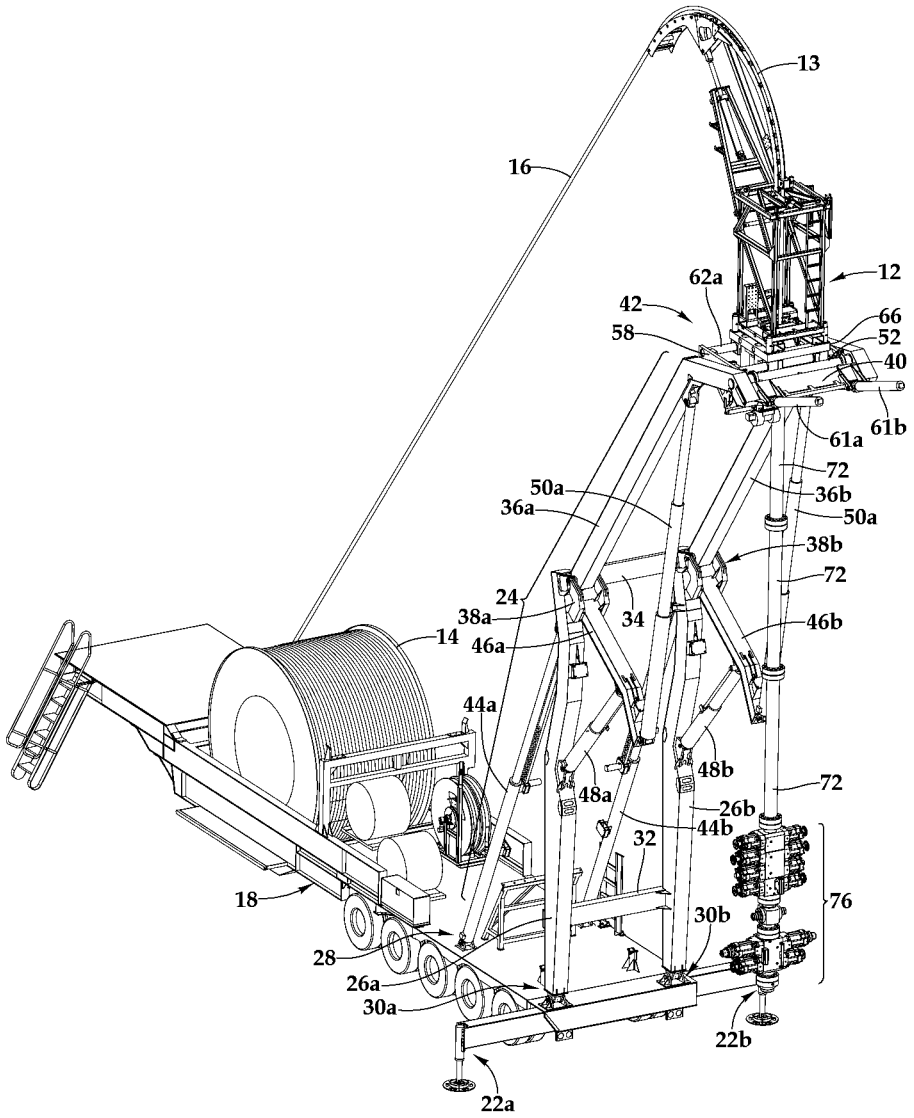
FIG. 3 is a perspective view of the coiled tubing unit of FIG. 1 with the handler extended and a blowout preventer assembly attached to the coiled tubing injector.
Figure 4:
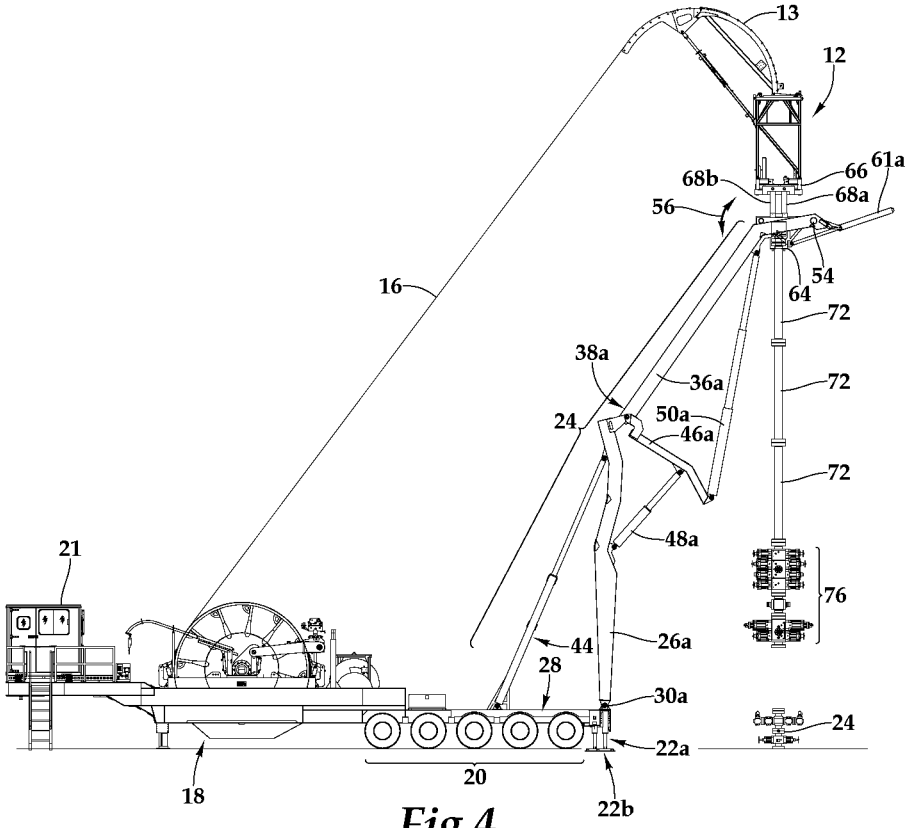
FIG. 4 is a side view of the coiled tubing unit of FIG. 3, with the handler having maneuvered the coiled tubing injector and BOP assembly over a wellhead.

Handler 10 is comprised of a linkage, which is generally indicated by reference number 24 in FIGS. 3 and 4. The linkage, in this example, includes two rigid links that are connected in a series to the trailer, which serves as a base; the proximal end of the first rigid link is connected to the base in a manner to allow pivoting; and the distal end of the first rigid link is connected to the proximal end of the second rigid link in a manner that allows pivoting. In this embodiment, each of the links is comprised of a pair of parallel, spaced-apart arms, each in the form of a steel beam.

The first rigid link, comprised of arms 26*a* and 26*b*, has a proximal end pivotally coupled to a base, which is the deck 28 of the trailer 12 in this example, by means of joints 30*a* and 30*b*, one for each arm. Cross members 32 connect the two arms near their proximal end and cross member 34 connects them near their distal end, thereby creating a rigid box or square shaped frame that comprises the first link.

Figure 2:
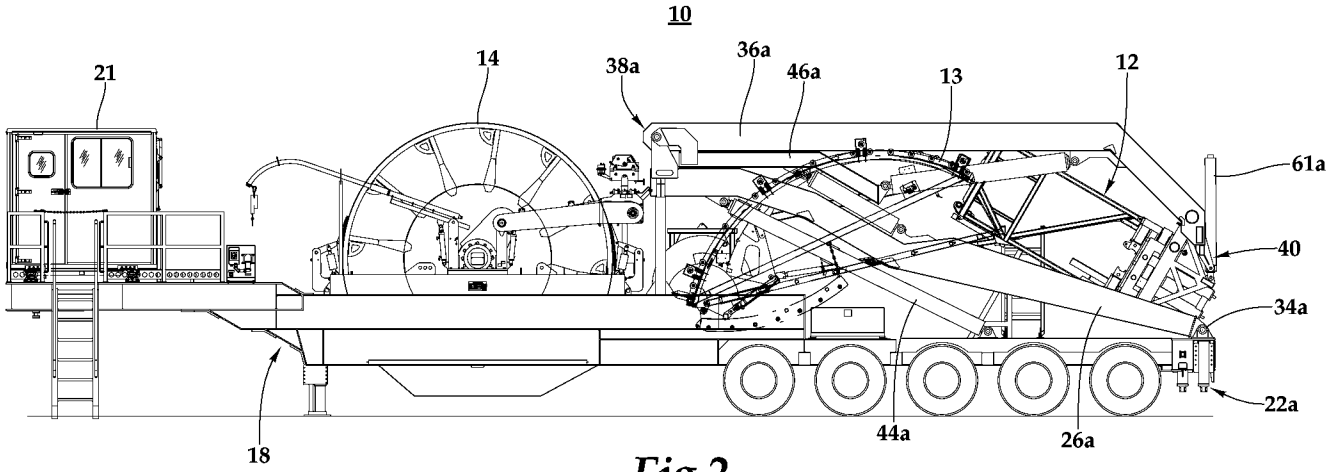
FIG. 2 is a side view of the coiled tubing unit of FIG. 1.

The second rigid link is comprised of arms 36*a* and 36*b*. Each of these arms is coupled to arms 26*a* and 26*b*, respectively, through joints 38*a* and 38*b*. The arms are held parallel by the joints and by cross-member 40. Arms 36*a* and 36*b* are not straight, as can be seen in the drawings. Each is bent near coiled tubing support platform 42. The bend in the link allows the handler, with the coiled tubing injector mounted to it, to be folded or collapsed into to a more compact arrangement when in the transport position. The arms 36*a* and 36*b* and the coiled tubing injector 12 are able to be placed in a position with a lower overall height when measured from the bed 28 of the trailer 18, when the handler is in the transport or stowed position as shown in FIGS. 1 and 2. In this example, the height of the handler, and in particular arms 36*a* and 36*b*, are approximately at the height (slightly higher for protecting the coiled tubing injector) as the coiled injector assembly when it is tilted into its stowed position, with it nearly touching the bed 28 of the trailer.

The first rigid link is pivoted with respect to the trailer bed 28, between a collapsed or transport position shown in FIGS. 1 and 2 and an upright position shown in FIGS. 3 and 4, by an extension means comprising two extendable members in the form of hydraulic cylinders 44*a* and 44*b*. The hydraulic cylinders 44*a* and 44*b* are pivotally attached to the bed 28 of the trailer and the distal end of each arm 26*a* and 26*b*, respectively. Alternatively, a single extendable member could be used.

To pivot the second rigid link with respect to first rigid link, a second extension means is used. In this example, the second extension means is comprised of multiple or plural extendable members and at least one middle beam or arm. Middle arms 46*a* and 46*b* are pivotally attached to joints 38*a* and 38*b*, respectively, and pivot or rotate the same axis as each of the arms 36*a* and 36*b* of the second link. Alternatively, each of the middle arms could be pivotally connected to the first link at a different point, further from the distal end each of the arms 26*a* and 26*b* of the first link. Hydraulic cylinders 48*a* and 48*b* extend or collapse in unison to pivot the middle arms with respect to the arms 26*a* and 26*b*. Each of the hydraulic cylinders 50*a* and 50*b* is connected between one of the middle arms 46*a* and 46*b* (nearer its distal end than where hydraulic cylinder 48*a* or 48*b* connects) and arms 36*a* and 36*b*, respectively, of the second link, nearer their distal end, where the arms bend. Hydraulic cylinders 50*a* and 50*b* operate in unison to pivot arms 36*a* and 36*b* with respect to the middle arms 46*a* and 46*b* (and thus also with respect to the arms 26*a* and 26*b* of the first link). By using a middle arm and an extendable member on each side of the middle arm, shorter extendable members can be used. Shorter extendable members less susceptible to buckling than longer ones.

Instead of or in addition to, a hydraulic cylinder, each extendable member mentioned herein may be comprised of a linear actuator, including a telescoping linear actuator with one or more telescoping segments, capable of carrying the loads and possessing the necessary stroke or length of movement. Possible alternatives include other types of hydraulic linear actuators, as well as pneumatic actuators and mechanical actuators (such as various types of screws, rack and pinions, chains, belts, and the like), including those driven by hydraulic, electric or other types of motors.

Figure 5:
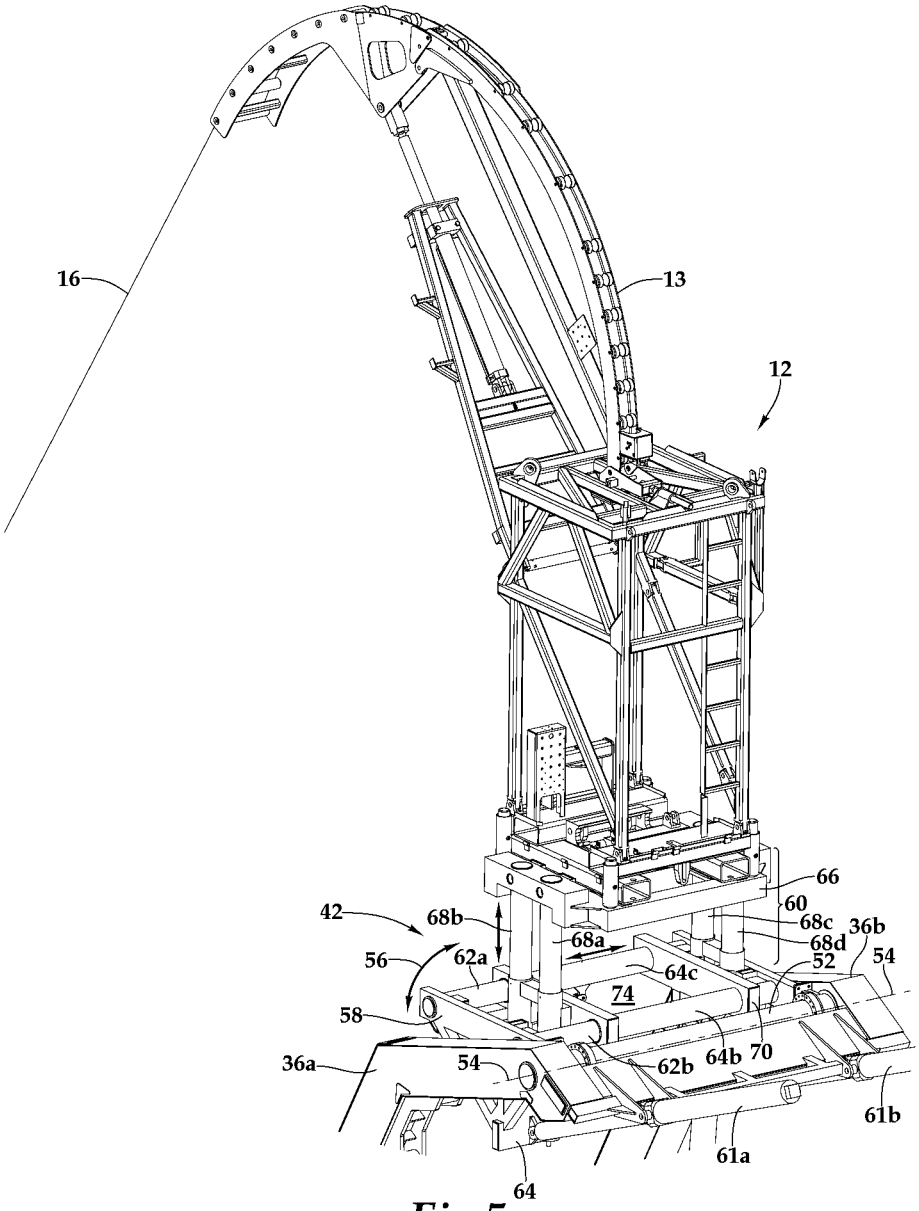
FIG. 5 is a perspective view of a platform of the handler of FIGS. 1-4.

Coiled tubing support platform 42 is coupled to the second link, nearer to the distal ends of its arms 36*a* and 36*b*, by tubular member 52 that allows the platform to rotate about axis 54 of the tubular member, tilting the platform, and thus coiled tubing injector 12, backward and forward as indicated by arrow 56 on FIG. 5. To rotate or tilt the frame, the embodiment relies on a pair of hydraulic cylinders 61*a* and 61*b* that are attached at one end to cross-member 40 and at the other end to lever plate 64 that extends below bottom frame 58 of platform 42.

The coiled tubing platform, in this representative embodiment, is comprised of bottom frame 58 and a carriage 60. The carriage slides on the platform. The frame includes a plurality (two in this example) tubular members 62*a* and 62*b* that form a track. The carriage includes tubular members 64*c* and 64*b* surround and slide on the tubular members 62*a* and 62*b*. The carriage thus slides on, and is retained on the bottom frame, by the track. Although not visible in the figures, the carriage is moved by a hydraulic cylinder. Other types of extendable mechanisms can be used to move the carriage.

The carriage is, in the illustrated embodiment, configured for raising and lowering the coiled tubing injector mounted on it. In the example of the embodiment in the figure, the carriage comprises a top frame 66, on which coiled tubing injector assembly 12 is mounted. The top frame, and thus the coiled tubing injector assembly 12, can be raised and lowered on the platform by a plurality of extendable members in the form hydraulic lifts or cylinders 68*a-d*. Actuating these cylinders, when the platform is horizontally oriented, results in raising the injector in the vertical direction. Retracting them lowers the injector in the same direction. The movement permits the coiled tubing injector assembly and the BOP assembly (risers 72 and blowout preventers 76 in FIGS. 3 and 4), after they have been attached to each other, to be raised up and correctly positioned over the wellhead, to be then lowered for attachment to the wellhead without having to operate the linkage. Only cylinders 68*a-d* have to be operated to do this. The coiled tubing injector assembly is shown in a raised position in FIGS. 4 and 5, and in a lowered position in FIG. 3. In the illustrated embodiment the hydraulic cylinders are connected between bottom carriage frame 70, which is comprised of the tubular members 64*c* and 64*b*, and the top frame 66. The coiled tubing injector is, in FIGS. 3 and 4, connected by a stripper (not visible) to the risers 72 through opening 74 in the support platform.

To operate the handler a controller (not shown) operates hydraulic circuits that, in turn cause the hydraulic cylinders described above to extend or contract.

The representative embodiment of the handler is capable of the following degrees of freedom of motion: up and down, or vertical movement with respect to the ground; in and out (or back and forth with respect to the base of the handler); rotation of the coiled tubing injector about the horizontal axis; movement side-to-side of the coiled tubing injector; and tilt side-to-side of the handler, and thus the coiled tubing injector, by controlling support outriggers on the base, such as a trailer to which the handler is mounted. In the embodiment illustrated in the accompanying figures, this is all done with a self-contained mechanism on a transport truck or trailer, without the use of a crane typical for this kind of operation.

Once the injector and pressure control stack is attached to the wellhead, the handler may continue to carry the load of the injector and pressure control stack (BOP and riser, for example). In the exemplary embodiment illustrated in the drawings, the reel on which the coiled tubing is wound is located so that the tension on the tubing, which is necessary to keep it wound on the reel, is in line with and in a favorable direction with the linkage. Therefore, the eccentric load produced by the tubing tension will be reacted by the injector handler and no bending moment will be induced into the wellhead. The handler shown in the illustrated example is capable of supporting the entire weight of the injector and pressure control stack, as well as the side load imposed by the tension in the coiled tubing, without a need for a crane or hoist cables.

Avoiding the need for a crane reduces cost, and it avoids the complexities and risks inherent in its use. When using a crane, the crane must remain connected to the coiled tubing injector assembly throughout the well servicing operation. It assures stability during rig-up and resists the sideways pull resulting from tension on the tubing between the tubing reel and the injector and tubing guide assembly. Because the injector assembly hanging from a crane acts as a pendulum, the crane operator must swing the crane against the pull from the tension placed on the tubing to offset it. If he does not swing far enough, the tubing strains against the wellhead. If he swings too far, the crane strains against the wellhead. The tubing tension generated by the tubing reel varies, between running into or out of the well, and during the tubing deployment as the spool of tubing changes diameter. Constant attention to the adjustment of the crane resisting the side pull must be made.

The handler is capable of supporting a coiled the tubing injector during each of the following operational steps: transport on a trailer or truck bed to a well site, elevating the coiled tubing injector to rest on a pressure control equipment (a blow out preventer and, if present, riser), placing the rigged up coiled tubing injector on the wellhead, and supporting the coiled tubing injector during a well servicing operation. In alternative embodiments aspects of the handler could be adapted to be utilized in just one or any combination of these operations. For example, in one alternative the handler need not be transported, but rather erected at a well site, such as on a rig. Another alternative embodiment might be to use aspects of the handler in ways suitable for raising and supporting the coiled tubing injector during rigging, with a crane or other structure being used to support the coiled tubing injector during operation. Or, conversely, a crane might be used to pull and hold up the injector during rigging, but aspects of the handler could be used to assist with maneuvering the coiled tubing injector on a BOP assembly, and/or support the injector and BOP assembly during well servicing.

The foregoing description is of exemplary embodiments. Alterations and modifications to the disclosed embodiments may be made without departing from the inventions taught by the examples. The meanings of the terms used in this specification are, unless expressly stated otherwise, intended to have ordinary and customary meaning, and are not intended to be limited to the details of the illustrated structures or the disclosed embodiments.

What is claimed is:

1. An apparatus for handling a coiled tubing injector at a well site and positioning it above a wellhead, the apparatus comprising:

a coiled tubing injector;

a support platform, on which is mounted the coiled tubing injector;

a linkage pivotally coupled with a base, the linkage extendable from a stowed position to an operational position in which the support platform is elevated and extended outwardly from the base;

the linkage comprising a plurality of links, the plurality of links comprising at least a first link and a second link, each of which has a proximal end and a distal end, wherein the proximal end of the first link is pivotally connected with the base, the support platform is pivotally connected to the second link near its distal end, and the proximal end of the second link is coupled through at least one joint to the distal end of the first link wherein the second link is pivotally connected to the distal end of the first link, and wherein the second link is bent between its proximal and distal ends, so that its distal end, where the coiled tubing injector support platform is pivotally connected, is lower to the ground than its proximal end when the linkage is in a collapsed position; and the linkage further comprising a first extendable member for pivoting the first link with respect to the base between a horizontal position and a vertical position, a second extendable member for pivoting the second link with respect to the first link, and a third extendable member for pivoting the coiled tubing support platform with respect to the second link, whereby extending the first and second extendable members from retracted to extended positions moves the linkage from the collapsed position for transportation to an extended position in which the support platform is raised and moved outwardly from the base.

2. The apparatus of claim 1, wherein the third extendable member pivots the support platform from a first orientation when the third extendable is retracted and the linkage is in a collapsed position, toward a second orientation when the third extendable member is extended and the linkage is moved by extending the first and second extendable members, the coiled tubing injector being tilted to one side in the first orientation and substantially vertical in the second orientation.

3. The apparatus of claim 1 wherein, the first link and the second link are each comprised of two arms that are spaced apart and parallel to each other;

the support platform is positioned between the two arms of the second link; and the coiled tubing injector is posited between the two arms of each link when the linkage is in a collapsed position.

4. The apparatus of claim 1, wherein the coiled tubing injector is mounted on a carriage that slides from side to side on the support platform.

5. The apparatus of claim 4, wherein the carriage comprises extendable members for raising and lowering the coiled tubing injector.

6. The apparatus of claim 1, wherein the coiled tubing injector is mounted on the support platform through at least one extendable member for moving the coiled tubing injector and up and down with respect to the support platform.

7. An apparatus for handling a coiled tubing injector at a well site and positioning it above a wellhead, the apparatus comprising:

a coiled tubing injector;

a support platform, on which is mounted the coiled tubing injector;

a linkage pivotally coupled with a base, the linkage extendable from a stowed position to an operational position in which the support platform is elevated and extended outwardly from the base;

the linkage comprising a plurality of links, the plurality of links comprising at least a first link and a second link, each of which has a proximal end and a distal end, wherein the proximal end of the first link is pivotally connected with the base, the support platform is pivotally connected to the second link near its distal end, and the proximal end of the second link is coupled through at least one joint to the distal end of the first link;

the linkage further comprising a first extendable member for pivoting the first link with respect to the base between a horizontal position and a vertical position, a second extendable member for pivoting the second link with respect to the first link, and a third extendable member for pivoting the coiled tubing support platform with respect to the second link, whereby extending the first and second extendable members from retracted to extended positions moves the linkage from a collapsed position for transportation to an extended position in which the support platform is raised and moved outwardly from the base; and wherein the linkage further comprises a third link that pivots at its proximal end with respect to the first link, and a fourth extendable member;

and wherein the second extendable member extends from the third link to the second link, and the fourth extendable member extends from the first link to the third link, such that extending and retracting the fourth extendable member pivots the third link, which then pivots the second link, and extending and retracting the second extendable member pivots the second link.

8. The apparatus of claim 7, wherein the base is comprised of a bed of a truck or a trailer; and wherein the apparatus further comprises a reel of coiled tubing, the linkage being mounted between the reel and an end of the base.

9. An apparatus for handling a coiled tubing injector at a well site and positioning it above a wellhead, the apparatus comprising:

a vehicle;

a reel of coiled tubing mounted on the vehicle;

a coiled tubing injector into which one end of the coiled tubing has been inserted;

a support platform, on which is mounted the coiled tubing injector;

a linkage pivotally coupled with the vehicle, the linkage extendable from a stowed position to an operational position in which the support platform is elevated and extended outwardly from the vehicle;

the linkage comprising a plurality of links, the plurality of links comprising at least a first link and a second link, each of which has a proximal end and a distal end;

wherein the proximal end of the first link is pivotally connected with the base, the support platform is pivotally connected to the second link near its distal end, and the proximal end of the second link is coupled through at least one joint to the distal end of the first link; and wherein the first link and the second link are each comprised of two arms that are spaced apart and parallel to each other, with the support platform positioned between the two arms of the second link, and the coiled tubing injector accommodated between the two arms of the each of the first and the second links when the linkage is in a transport position, wherein the second link is pivotally connected to the distal end of the first link, and wherein the second link is bent between its proximal and distal ends, so that its distal end, where the coiled tubing injector support platform is pivotally connected, is lower to the ground than its proximal end when the linkage is collapsed;

wherein the linkage further comprises a first extendable member for pivoting the first link with respect to the base between a horizontal position and a vertical position, a second extendable member for pivoting the second link with respect to the first link, and a third extendable member for pivoting the coiled tubing support platform with respect to the second link; wherein the linkage is collapsed when in the transport position, with the coiled tubing injector tilted to one side with respect to its normal operating position, and moved to an extended position in which the support platform is raised and moved outwardly from the vehicle, with the coiled tubing injector in a substantially vertical orientation, while the coiled tubing remain inserted in the coiled tubing injector.

10. The apparatus of claim 9, wherein the coiled tubing injector is mounted on a carriage that slides from side to side on the support platform and raises and lower the coiled tubing injector.

11. An apparatus for handling a coiled tubing injector at a well site and positioning it above a wellhead, the apparatus comprising:

a vehicle;

a reel of coiled tubing mounted on the vehicle;

a coiled tubing injector into which one end of the coiled tubing has been inserted;

a support platform, on which is mounted the coiled tubing injector;

a linkage pivotally coupled with the vehicle, the linkage extendable from a stowed position to an operational position in which the support platform is elevated and extended outwardly from the vehicle;

the linkage comprising a plurality of links, the plurality of links comprising at least a first link and a second link, each of which has a proximal end and a distal end; wherein the proximal end of the first link is pivotally connected with the base, the support platform is pivotally connected to the second link near its distal end, and the proximal end of the second link is coupled through at least one joint to the distal end of the first link; and wherein the first link and the second link are each comprised of two arms that are spaced apart and parallel to each other, with the support platform positioned between the two arms of the second link, and the coiled tubing injector accommodated between the two arms of the each of the first and the second links when the linkage is in a transport position;

wherein the linkage further comprises a first extendable member for pivoting the first link with respect to the base between a horizontal position and a vertical position, a second extendable member for pivoting the second link with respect to the first link, and a third extendable member for pivoting the coiled tubing support platform with respect to the second link; wherein the linkage is collapsed when in the transport position, with the coiled tubing injector tilted to one side with respect to its normal operating position, and moved to an extended position in which the support platform is raised and moved outwardly from the vehicle, with the coiled tubing injector in a substantially vertical orientation, while the coiled tubing remain inserted in the coiled tubing injector;

wherein the linkage further comprises a third link that pivots at its proximal end with respect to the first link, and a fourth extendable member;

and wherein the second extendable member extends from the third link to the second link, and the fourth extendable member extends from the first link to the third link, such that extending and retracting the fourth extendable member pivots the third link, which then pivots the second link, and extending and retracting the second extendable member pivots the second link.

12. The apparatus of claim 11, wherein the coiled tubing injector is mounted on a carriage that slides from side to side on the support platform.

13. The apparatus of claim 12, wherein the carriage comprises extendable members for raising and lowering the coiled tubing injector.

* * * * *